United States Patent [19]

Truckner et al.

[11] Patent Number: 4,685,505

[45] Date of Patent: Aug. 11, 1987

[54] NON-CONTACTING SIDE EDGE DAM MEANS FOR ROLL CASTING

[75] Inventors: William G. Truckner, Avonmore; Charles L. Jordan, New Kensington; William R. Sharkins, Curtisville, all of Pa.

[73] Assignee: Aluminum Company of America, Pittsburgh, Pa.

[21] Appl. No.: 816,240

[22] Filed: Jan. 6, 1986

[51] Int. Cl.[4] ..... B22D 11/06

[52] U.S. Cl. ..... 164/415; 164/428

[58] Field of Search ..... 164/428–432, 164/436, 480–482, 491, 415, 475

[56] References Cited

U.S. PATENT DOCUMENTS

| | | | |
|---|---|---|---|
| 4,020,890 | 5/1977 | Olsson | 164/49 |
| 4,222,431 | 9/1980 | Bryson | 164/89 |
| 4,262,734 | 4/1981 | Liebermann | 164/423 |
| 4,353,408 | 10/1982 | Pryor | 164/48 |
| 4,358,416 | 11/1982 | Yarwood et al. | 264/22 |
| 4,367,783 | 1/1983 | Wood et al. | 164/452 |
| 4,375,234 | 3/1983 | Pryor | 164/452 |
| 4,380,262 | 4/1983 | Adler et al. | 164/423 |
| 4,419,177 | 12/1983 | Pryor et al. | 156/601 |
| 4,461,338 | 7/1984 | Sundberg | 164/466 |
| 4,471,832 | 9/1984 | Yarwood et al. | 164/503 |
| 4,473,105 | 9/1984 | Pryor | 164/467 |
| 4,546,811 | 10/1985 | Potard et al. | 164/66.1 |

FOREIGN PATENT DOCUMENTS

| | | | |
|---|---|---|---|
| 0071802 | 2/1983 | European Pat. Off. . | |
| 55-73447 | 6/1980 | Japan | 164/480 |
| 59-193742 | 11/1984 | Japan | 164/428 |
| 1529731 | 10/1975 | United Kingdom . | |
| 908487 | 2/1982 | U.S.S.R. . | |

*Primary Examiner*—Nicholas P. Godici
*Assistant Examiner*—Richard K. Seidel
*Attorney, Agent, or Firm*—Andrew Alexander; John P. Taylor

[57] ABSTRACT

An improvement in roll casting apparatus is disclosed which comprises side edge dam means for delivering a flow of gas toward the side edges of metal as it passes, from a source of molten metal, through a pair of opposing roll casting means to thereby contain the side flow of such metal during the roll casting operation. In a preferred embodiment, the gas is directed toward the cast metal through porous side edge dam means attached to a plenum which is inserted into the nip of the roll casting means.

5 Claims, 6 Drawing Figures

NON-CONTACTING SIDE EDGE DAM MEANS FOR ROLL CASTING

BACKGROUND OF THE INVENTION

1. Field of the Invention

This invention relates to roll casting of metal, such as aluminum. More particularly, this invention relates to side edge dam means for roll casting which restrain the edges of the metal, as it is cast, without necessarily physically contacting the metal.

2. Description of the Prior Art

In roll casting apparatus, a nozzle tip is located adjacent to the nip of a pair of rollers to deliver a stream of molten metal to the rollers. Particular improvements in such apparatus are described and claimed in pending Ai et al Ser. Nos. 597,834 and 597,835; and Yu et al Ser. Nos. 597,911 and 597,912; all assigned to the assignee of this invention, and cross-reference to which is hereby made.

The usual practice in such roll casting apparatus is to provide stationary side edge dams adjacent the exit of the nozzle to retain the edge of the molten metal flow as it enters the rollers. In the use of this type of "contacting" edge dam, the amount of contact varies with the casting conditions. However, when contact does occur, rough or ragged sheet edges can result from this contact.

A number of prior art patents have addressed the problem of containing or shaping the flow of molten metal in a non-contacting manner using electromagnetic field means. Typical of such patents are U.S. Pat. Nos. 4,020,890; 4,353,408; 4,358,416; 4,375,234; 4,419,177: 4,461,338; and 4,471,832; and British Patent No. 1,529,731.

Wood et al U.S. Pat. No. 4,367,783 discloses the use of side edge dams which may be urged against the metal either by springs or hydraulic means under the control of a pressure sensing load cell means.

European Patent Application No. 0,071,802, published Feb. 16, 1983 discloses the use of a combination of electromagnetic and pneumatic means to seal the gap between a casting nozzle tip and upper and lower casting belts in an apparatus having solid side walls.

There remains, however, a need to provide means for essential non-contacting containment of the side edges of the molten and/or solid metal during casting which will be relatively simple and inexpensive, and yet possess the flexibility to permit changing the width of the material being cast "on the fly", i.e., as the metal is being cast. This, of course, effectively precludes the use of expensive and stationary electromagnetic field generating means.

SUMMARY OF THE INVENTION

It is, therefore, an object of this invention to provide essentially non-contacting side edge dam means to contain the metal during roll casting of molten metal from a nozzle tip.

It is another object of this invention to provide simple, inexpensive, essentially non-contacting side edge dam means to contain the metal during roll casting of molten metal from a nozzle tip.

It is yet another object of this invention to provide simple, inexpensive, essentially non-contacting side edge dam means to contain the metal during roll casting of molten metal from a nozzle tip which may be easily adjusted for changes in the width of the metal being cast.

It is a further object of this invention to provide essentially non-contacting side edge dam means to contain the metal during roll casting of molten metal from a nozzle tip which comprise a gas stream directed toward the side edge of the metal during casting.

It is yet a further object of this invention to provide essentially non-contacting side edge dam means to contain the metal during roll casting of molten metal from a nozzle tip which comprise porous metal side dams through which a gas stream flows toward the side edge of the metal during casting.

These and other objects of the invention will become apparent from the following description and the accompanying drawings.

In accordance with the invention, an improved roll casting apparatus comprises means for delivering a flow of gas toward the side edges of metal as it passes through a pair of opposing roll casting means from a source of molten metal to thereby contain the side flow of such metal during the roll casting operation.

DESCRIPTION OF THE PREFERRED EMBODIMENTS

Figure 1:
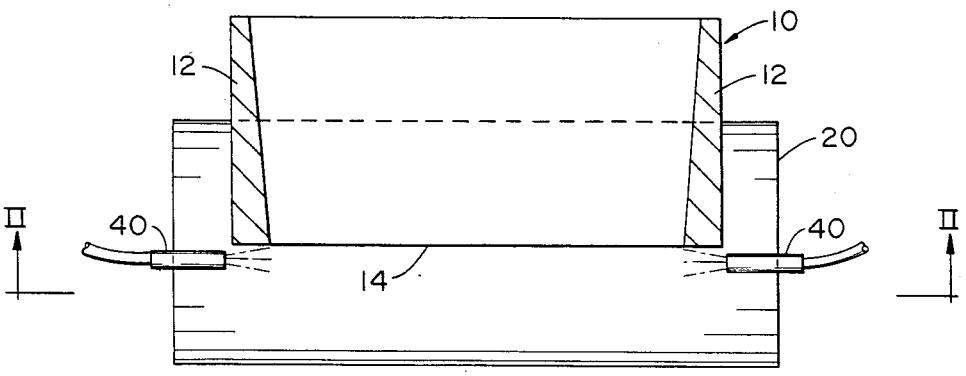
FIG. 1 is a top view illustrating the apparatus of the invention.

Turning now to FIG. 1, the invention is illustrated in its simplest form. In this top view, a convergent nozzle tip assembly 10 with converging sidewalls 12 is shown positioned over lower roller 20 with the end edge 14 of tip assembly 10 terminating at approximately the center of roller 20. An upper roller 30 (FIG. 2) is positioned above roller 20 at this point to form the nip of rollers 20 and 30 which engages the molten metal as it flows from tip assembly 10.

In accordance with the invention, side edge dam means 40 which, in this embodiment, comprise tubes or nozzles are positioned between rollers 20 and 30 adjacent sidewalls 12 of tip assembly 10 to direct respective streams of gas toward the side edges of metal 50 normal to the flow of the metal as it emerges from tip assembly 10 and is contacted by rollers 20 and 30. This flow of gas provides a restraining influence for the metal flow which is non-contacting in the sense of a contact between a solid side edge and a solid or liquid metal. The result is a smooth side edge on metal 50 in contrast to the ragged edges which characterize at least some of the prior art approaches to this problem.

The gas, which is delivered through side edge dam means 40 against the side edges of metal 50 being cast, may be either pressurized air or any other gas; preferably an inert or nonreactive gas such as, for example, Argon or Nitrogen. The gas, which may be supplied to side edge dam means 40 through any conventional delivery means (not shown), should be delivered against the metal edge at a pressure which is at least slightly higher than the pressure exerted by the molten metal and may be as high as 50 psi. Typically the pressure will vary from about 15 to 50 psi, preferably about 25 to 35 psi, and most preferably about 30 psi, to provide sufficient restraint for the metal as it flows from tip assembly 10 and between rollers 20 and 30. The exact pressure will vary somewhat depending upon the process parameters of the particular roll casting process, i.e., the temperature of the metal, the flow rate of the metal (speed of the casting), the spacing between rollers 20 and 30, and especially the flow rate of the gas (based on porosity or oriface sizes of edge dam means 40).

Figure 2:
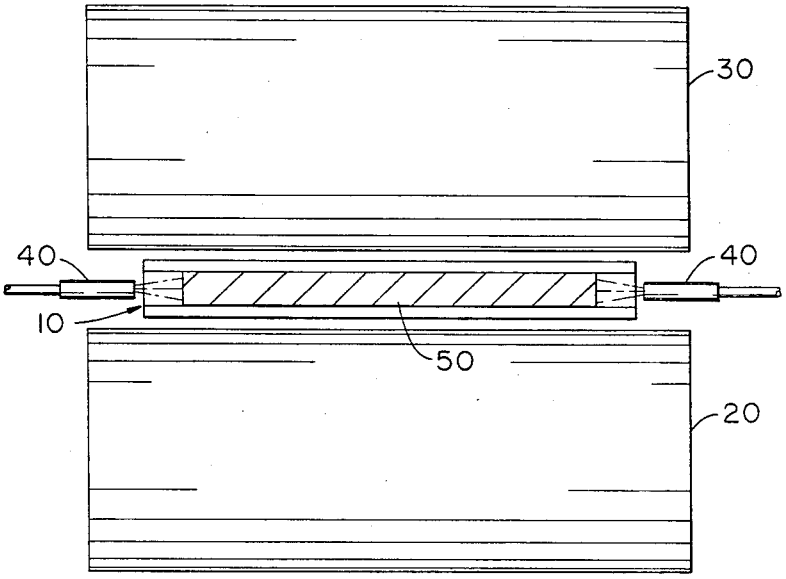
FIG. 2 is an end view of the apparatus of FIG. 1 taken along lines II—II.

With regard to the illustrated spacing between the rollers in FIG. 2, it should be noted that the rollers have been shown an exaggerated distance apart for illustrative purposes only. In actual practice, the spacing between the rollers in a typical roll casting apparatus may, for example, only be about $\frac{1}{8}$ to $\frac{1}{2}$ inches for rollers having diameters of from, for example, 14 to 38 inches. The spacing of the nip of rollers 20 and 30 is also exaggerated in FIG. 2 relative to the thickness of nozzle tip assembly 10 for illustrative purposes only. In actual practice, the spacing between upper end edge 14 and lower end edge 16 of tip assembly 10 would be very close to the spacing at the confluence (nip) of rollers 20 and 30 to minimize the transition of the metal flow between the nozzle tip assembly and the rollers.

Figure 3:
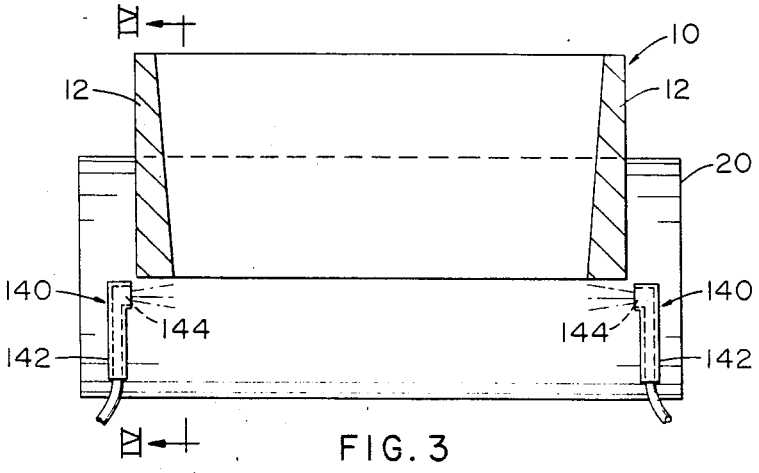
FIG. 3 is a top view of another embodiment of the invention.
Figure 4:
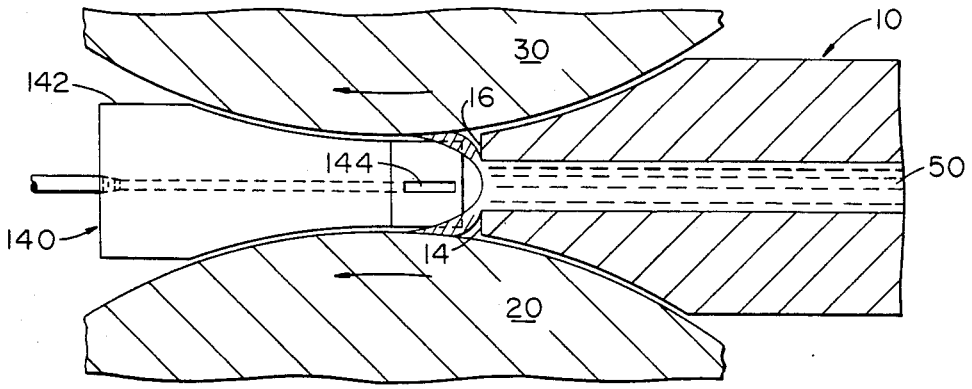
FIG. 4 is a side view of the embodiment of FIG. 3 taken along lines IV—IV.

Another embodiment of the invention is shown in FIGS. 3 and 4 wherein side edge dam means 140 comprise a plenum 142 which is inserted from the opposite side of rollers 20 and 30 from tip assembly 10. In this embodiment, the gas delivery means may comprise a slot 144 formed in the side of plenum 142 to direct the gas flow toward the metal as it flows through the nip of rollers 20 and 30.

It should be further noted here, that one of the advantages of the invention is the ease with which the side edge dam means, in either illustrated embodiment, can be adjusted for changes in the width of the metal being cast in the apparatus, including changes made "on the fly", i.e., during the casting operation. Thus, when it is desired to change the width of the metal being cast, the side edge dam means may be physically moved apart or closer, as the case may be, and adjustments to the gas pressure can then also be used to provide a fine tuning or adjustment of the metal width.

Figure 5:
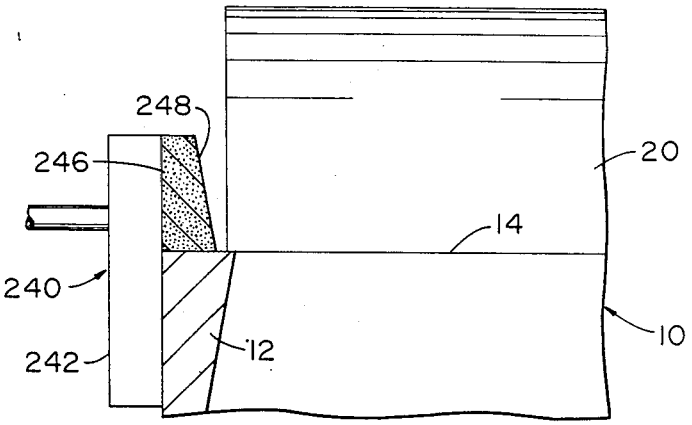
FIG. 5 is a fragmentary top view of yet another embodiment of the invention.
Figure 6:
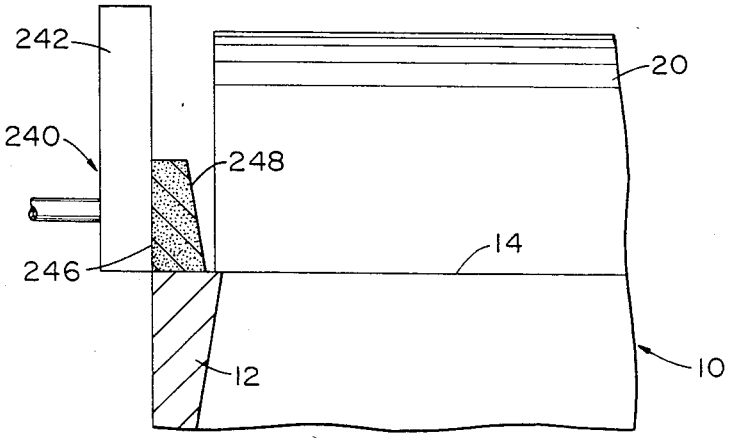
FIG. 6 is a fragmentary top view of an alternative to the embodiment of FIG. 5.

FIGS. 5 and 6 illustrate yet another embodiment of the invention wherein slot 144 of side edge dam means 140 is replaced by a porous block 246 in side edge dams means 240 through which the gas stream will flow from plenum 242 toward the metal being cast. Porous block 246 may comprise a porous metal material, such as a porous bronze or a nonmetallic material, for example, a porous graphite material. Porous block 246 is illustrated with a slanted edge 248 which provides close proximity with metal 50 adjacent the nip of rollers 20 and 30 and then provides a relieved or divergent opening should the metal come in contact with side edge dam means 240.

Thus, the invention provides novel side edge dam means which will direct a stream of gas against the side edge of metal being cast to provide a restraint essentially without a liquid or solid contact between the restraining means and the cast metal. By providing a gaseous means rather than the electromagnetic noncontacting means of the prior art, the size, expensive, and complexity of the apparatus is reduced. Furthermore, the flexibility of the apparatus is increased by making it possible to easily adjust or change the width of the metal being cast by either physically moving the side edge dam means apart or closer together, or by adjusting the pressure of the gas flowing through the side edge dam means.

Having thus described the invention, what is claimed is:

1. An improved roll casting apparatus comprising side edge dam means comprising laterally adjustable plenum means with porous gas egress means therein located at the nip of a pair of opposing rollers for delivering a flow of gas at a pressure of up to 35 psi toward the side edges of metal as it flows, from a nozzle tip assembly in communication with a source of molten metal, through said nip of said opposing rollers to thereby contain the side flow of such metal during the roll casting operation, said porous gas egress means having a slanted edge diverging away from the side of said metal beyond the nip of sid rollers to provide a divergent opening in the direction of metal flow.

2. The apparatus of claim 1 wherein said plenum means extend parallel to said metal flow toward said source of molten metal.

3. The apparatus of claim 1 wherein said plenum means extend parallel to said metal flow in a direction away from said source of molten metal.

4. The apparatus of claim 1 wherein said porous means comprise a porous graphite means through which said gas flows toward said side edge of said metal being cast.

5. The apparatus of claim 1 wherein said porous means carried by said plenum means comprise porous metal means.

* * * * *